US006035689A

United States Patent [19]

Chang et al.

[11] Patent Number: 6,035,689

[45] Date of Patent: Mar. 14, 2000

[54] RIGID SHEET METAL RIVET BUTTON FABRICATION FOR CONVENIENCE-FEATURE CAN STOCK

[75] Inventors: Der-Form Chang, Oakdale; Jyhwen Wang, Coraopolis, both of Pa.

[73] Assignee: Weirton Steel Corporation, Weirton, W. Va.

[21] Appl. No.: 09/103,390

[22] Filed: Jun. 24, 1998

Related U.S. Application Data

[60] Provisional application No. 60/051,123, Jun. 27, 1997.

[51] Int. Cl.[7] ..... B21D 51/38

[52] U.S. Cl. ..... 72/379.4; 413/12

[58] Field of Search ..... 29/509; 72/356, 72/379.2, 379.4; 413/12, 14

[56] References Cited

U.S. PATENT DOCUMENTS 3,638,597 2/1972 Brown ..... 29/509

FOREIGN PATENT DOCUMENTS

96/36447 11/1996 WIPO ..... 72/379.4

*Primary Examiner*—Lowell A. Larson
*Attorney, Agent, or Firm*—Shanley and Baker

[57] ABSTRACT

Processing steps and tooling (FIGS. 5–7, 10–13 and 14–16) of the invention enable replacement of prior practice rivet button processes [FIGS. 3(*a*)–(*d*)] which progressively decreased unitary rivet button sheet metal thickness gauge so as to preclude use of thinner-gauge sheet metal (about 50 to 70 #/bb) rigid flat-rolled steel due to surface cracking (FIG. 4). Flat-rolled steel and rigid aluminum alloy sheet metal can be selected in new thickness gauges and preferred characteristics for container manufacture through use of the disclosed process [FIGS. 8(*a*)–(*c*)], which helps to achieve a major portion of desired rivet button height with only a minor decrease in starting thickness gauge [FIGS. 9(*a*) and (*b*)] to enable achieving desired final rivet button height with substantially uniform rivet button sheet metal thickness of greater than seventy-five percent of starting thickness gauge.

12 Claims, 14 Drawing Sheets

RIGID SHEET METAL RIVET BUTTON FABRICATION FOR CONVENIENCE-FEATURE CAN STOCK

RELATED APPLICATION

This application claims the benefit of U.S. Provisional Application Serial No. 60/051,123, filed Jun. 27, 1997.

INTRODUCTION

The present invention is concerned with improving rivet button fabrication and manufacture of container-closure structures which rely on use of a unitary rivet to secure a convenience-feature opener to sheet metal which is to be severed during opening. In one of its more specific aspects, this invention enables fabrication of thin-gauge, higher tensile-strength flat-rolled steel can stock into easy-open end closures into a unitary rivet button, and subsequent forming of rivet with rivet head for securing a convenience-feature opener to such end closure, free of concern with surface cracking or splitting of such thin-gauge sheet metal. More generally, the invention is concerned with making provisions for forming a unitary rivet button, and subsequent rivet fabrication for securing a convenience-feature opener to container sheet metal, in a manner which enables a broader selection of rigid flat-rolled sheet metals for easy-open closure structures, and of sheet metal characteristics, than that previously available for container-closure manufacture.

RECOGNIZING THE PROBLEM

No prior canmaking practice has permitted use of thin-gauge high-tensile strength rigid flat-rolled sheet metal can stock, such as double-reduced flat-rolled steel, for forming a unitary rivet button for securing a convenience- feature opener to an easy-open end closure.

OBJECTS OF THE INVENTION

A primary object is to identify factors which imposed such limitations of the prior practice; equally important is to increase applications for rigid flat-rolled sheet metals of differing characteristics by improving fabricating processing of such unitary rivet button, and to provide novel tool sets for interrelating processing steps so as to improve commercial fabrication of easy-open rigid sheet metal container-closure structures.

More specific objects include enabling selection of rigid flat-rolled sheet metal container-closure stock: (a) which provides a preferred thin-gauge high tensile-strength sheet metal not previously available for commercial manufacture of convenience-feature container structures, (b) which provides for fabricating an elongated unitary rivet button and selection of sheet metal thickness along such longitudinal height for desired forming of a unitary rivet, (c) which facilitates selection of sheet metal and sheet metal characteristics so as to enable a quantitative decrease in rigid flat-rolled sheet metal requirement, and (d) which facilitates a broader selection of sheet metal characteristics for ease of opening of a convenience-feature end closure.

As used herein, "rigid" refers to thickness gauges which distinguish flat-rolled sheet metal from metal foil.

The above objects and other advantages and contributions are considered in more detail during disclosure of processing steps, tooling, and resulting product of the invention, which are described with reference to several views of the accompanying drawings.

DETAILED DESCRIPTION OF THE INVENTION

Thicker-gauge sheet metal and/or a larger size rivet head (FIG. 1), as required by prior rivet button forming practices, limited the sheet metals and sheet metal characteristics available for fabrication of satisfactory rivet button and unitary rivet for easy-open container-closure structure. The processing of the present invention provides a broader selection of rigid sheet metals, and sheet metal characteristics, for manufacture easy-open can end closures.

Figure 1:
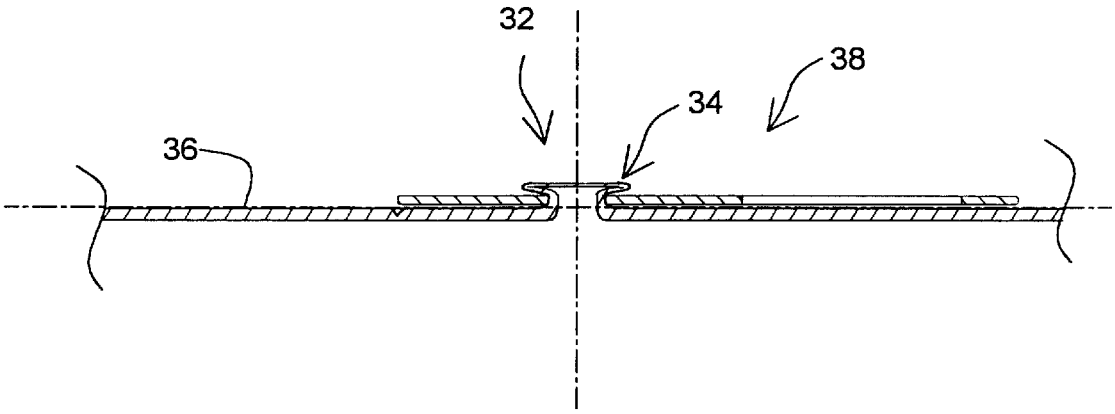
FIG. 1 (PRIOR ART)
FIG. 1 is a schematic cross-sectional elevational partial view for describing an easy-open closure structure and the heavy-gauge flat-rolled sheet metal required by prior practice for fabricating a unitary rivet button and rivet.
Figure 2:
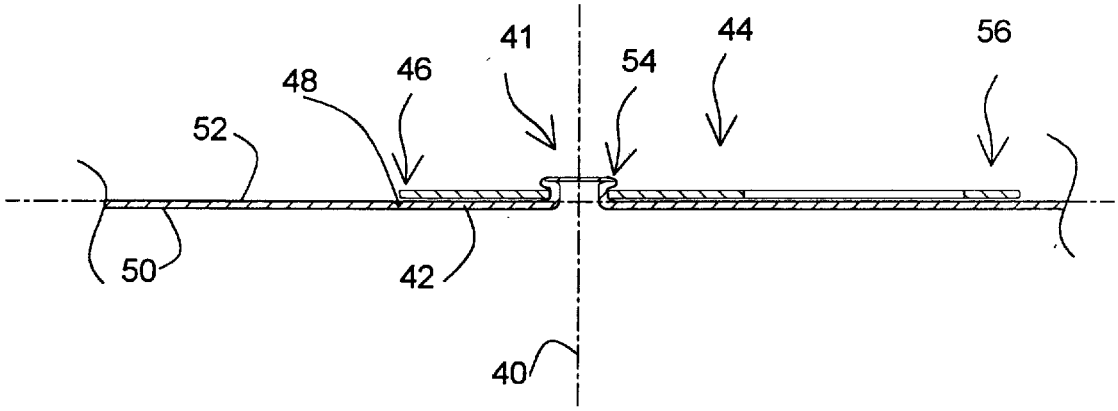
FIG. 2 is a schematic cross-sectional elevational partial view for describing a convenience-feature closure structure made with thin-gauge rigid flat-rolled sheet metal and the differing unitary rivet dimensions, made available in accordance with the invention.

In a specific embodiment of the invention, thinner-gauge sheet metal and smaller-size rivet head, as shown in FIG. 2, have been made available by teachings of the present disclosure. Prior practices required heavier sheet metal gauge and larger-diameter rivet heads, as shown in FIG. 1. Such prior practices significantly thinned sheet metal, at the closed end ("crown") of the unitary rivet button during forming of the rivet button.

Figure 3:
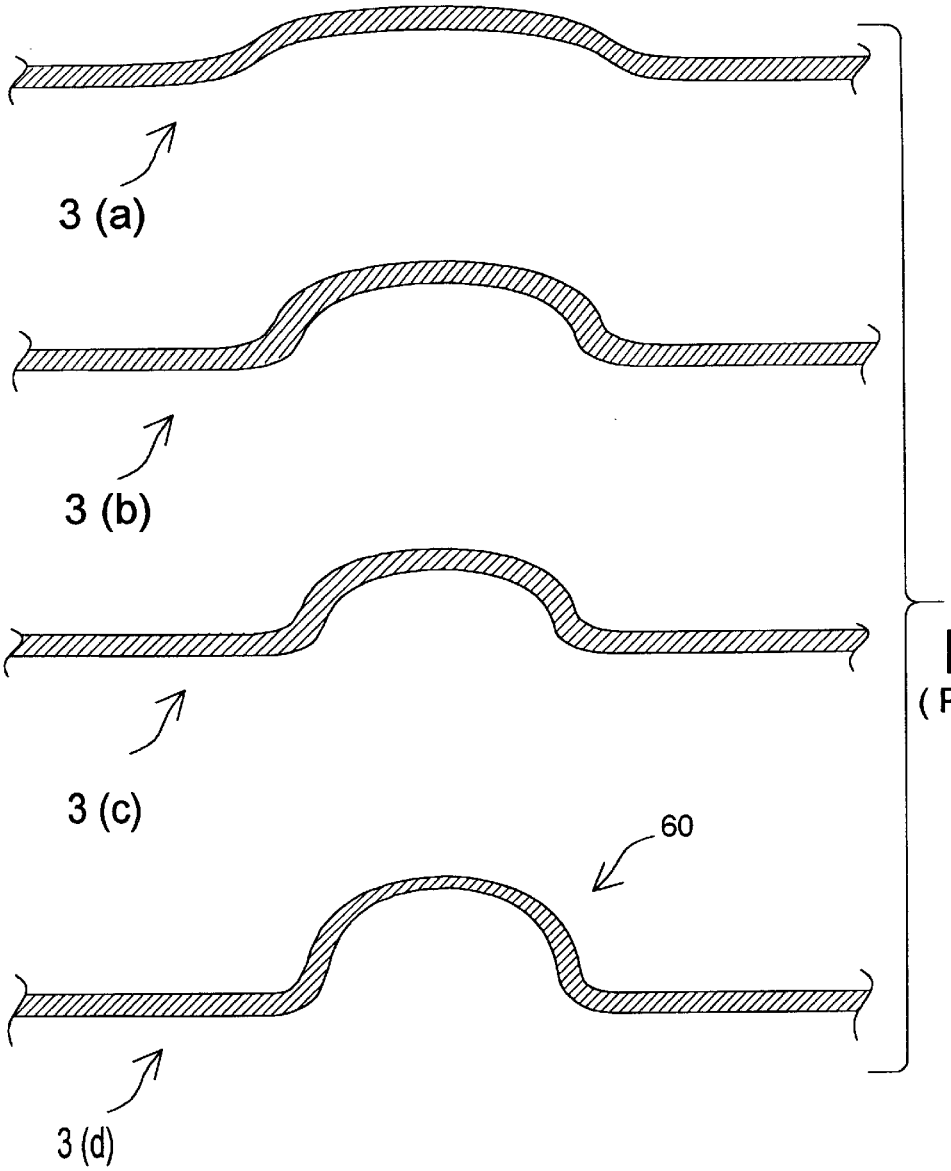
FIG. 3 ( PRIOR ART )
FIG. 3(*a*) through FIG. 3(*d*) are schematic cross-sectional elevational partial views for describing prior practices for rivet button fabrication.

That shortcoming of prior practices, in relation to a prior processing method, is depicted by FIGS. 3(*a*) through 3(*d*). In that prior practice embodiment, progressively smaller diameter and increased rivet button height were carried out in a plurality of steps, resulting in the rivet button 28 of FIG. 3(*d*). The shortcoming of such prior practices was that a significant strain-deformation of the metal at the crown, or closed end, of the rivet button sheet metal occurred during processing steps leading into, and during, forming of the rivet button.

Figure 4:
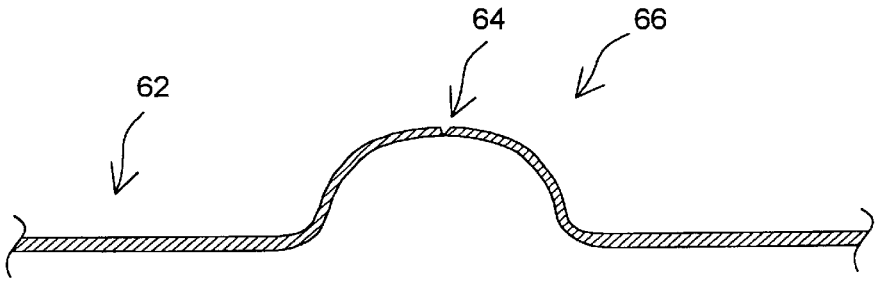
FIG. 4 is a schematic cross-sectional elevational partial view for describing one result of application of prior rivet button practices to a thin-gauge high tensile-strength rigid flat-rolled end closure stock, which is avoided by the present invention.

One disadvantage of prior practices is that cracking (or splitting) at the crown of the rivet button metal, as shown in FIG. 4, occurs when prior practices are used on such thin-gauge double-reduced flat-rolled steel. There are other disadvantages in the quality of the rivet button pointed out herein; but, prior rivet button practice could not function satisfactorily on flat-rolled steel, other than single-reduced (SR) steel of at least about seventy-five pounds per base box.

Similar restrictions and comparable limitations applied into fabrication of a unitary rivet button, by prior practices, on other rigid flat-rolled sheet metal can stock, such as aluminum as alloyed with manganese and magnesium, for easy-open can ends.

Present processing of rigid flat-rolled sheet metal can stock for fabricating a unitary rivet button overcomes such prior practice shortcomings by substantially limiting strain-deformation in the sheet metal relied on for forming the rivet button. As a result, rigid flat-rolled sheet metals, not previously available for sheet metal end closure manufacture, are permitted; and, a wider range of sheet metal characteristics and rivet button dimensions are made available for use with various easy-open closure-structures for canned comestibles.

In prior practice for forming an elongated rivet button, a longitudinal height of about 0.091" was required for forming rivet 32, with rivet head 34 of FIG. 1, from relatively heavy-gauge (about 75 #/bb to about 85 #/bb) single-reduced flat-rolled steel 36. Opener 38 required an aperture diameter of about 0.1875" for receiving the prior practice rivet button for formation of rivet 32.

In a double-reduced flat-rolled steel embodiment of FIG. 2, a geometric center is established by vertically-oriented axis 40 for the stem and head of rivet 41. A rivet button for the embodiment of FIG. 2 is formed, as described in relation to later tooling FIGS., from a thin-gauge high tensile-strength sheet metal 42, such as double-reduced flat-rolled steel.

Thin-gauge double-reduced flat-rolled steel with a high tensile-strength of about seventy-five to about eighty ksi is a preferred sheet metal for fulfilling later-described concepts of the invention; such double-reduced steel provides improved sheet metal characteristics, such as: increased strength per relative thickness of residual scoreline metal, and improvement of easy-open characteristics by providing a "snap-action" initial rupture of such residual scoreline metal while enabling decrease in container weight without decreasing strength characteristics of the container-closure structure.

Such "snap-action" initial scoreline rupture characteristics for a rigid sheet metal also augment and facilitate a follow-up tearing action of residual scoreline metal to complete opening of a convenience-feature end closure of the invention. And selecting a higher tensile-strength, with present teachings, improves unitary rivet head strength so as to permit a decrease in the sheet metal required for integrally securing a convenience-feature opener to a scored portion of container-closure sheet metal wall; and, also, with selected sheet metal, permits decrease in the diameter of a unitary rivet button and rivet stem which augments lever action, pivoting about a unitary rivet as a fulcrum, for initial rupture of a scoreline during easy-open procedures. Any decrease in the overall weight of an end closure structure is a significant factor in the provision of the capability for selecting lighter-gauge higher tensile-strength sheet metals.

The terms "single-reduced" (SR) and "double-reduced" (DR), as applied to flat-rolled steels, refer to cold-rolling procedures which decrease thickness-gauge of flat-rolled steel for can stock uses. Single-reduced (SR) flat-rolled steel can stock, as used in prior convenience-feature end closure manufacture and rivet button fabricating practice, required a relatively heavy-gauge (of at least about 75 #/bb to about 85 #/bb) lower tensile-strength (about 50 to 60 ksi) sheet metal. Present teachings provide certain advantages when applied to SR-flat-rolled steel.

Double-reduced (DR) flat-rolled steel refers to a double reduction in thickness gauge of flat-rolled steel, without an intermediate anneal (heat treatment). Such lighter-gauge double-reduced flat-rolled steel (about 50 #/bb to about 70 #/bb) with a tensile-strength of about seventy to about eighty ksi (Temper 8). The teachings of the invention provide multiple advantages in the use of such double-reduced steel.

Container-closure sheet metal 42 (FIG. 2) preferably presents substantially-planar scored portion for securing integral opener 44 in place. Opener 44 includes working end 46 which is positioned contiguous to scoreline 48 as opener 44 is integrally secured to sheet metal 42 by unitary rivet 41. Such sheet metal is described as having a "product side" surface (designated 50 in FIG. 2) which confronts the interior of a container; and, a "public side" surface (designated 52) which confronts the exterior of a container. End closure sheet metal is preferably scored on a substantially-planar portion of the public side surface.

An elongated unitary rivet button is fabricated with its axial longitudinal height protruding in such exterior direction from the "public side" surface. A rivet head 54, such as 54 of FIG. 2, is formed from sheet metal of and near the "crown" of the elongated rivet button which protrudes through a rivet button aperture in the opener. Such sheet metal at and near the end of the rivet button protruding from an aperture presented by opener 44 is subjected to impact-forming of a unitary rivet head for securing opener 44 to a scored portion of the sheet metal. The surface area of unitary rivet head (such as 54) is selected to be sufficient to hold the integral opener when handle end 56 of opener 44 is lifted so as to rupture scoreline 48. Selecting the sheet metal and sheet metal characteristics, with teachings of the present disclosure, can provide for forming a shorter-height rivet button and a smaller surface area rivet head.

In tests conducted to determine relative height of an elongated rivet button, in order to provide sufficient metal to form a rivet head capable of securing an integral opener, it was found that about a six percent (6%) decrease in height (to 0.086") was available when using high tensile-strength double-reduced flat-rolled steel can stock, as compared to the height required (about 0.091") when using single-reduced flat-rolled steel.

Decreasing height requirements for an elongated unitary rivet button additionally plays a role in decreasing strain-deformation of the sheet metal at the crown of rivet button during rivet button fabrication.

Such strain-deformation and its rivet button location, as identified by the present invention, are described in relation to a prior practice shown in FIGS. 3(*c*) through (*d*). Such strain-deformation of the closed end of the rivet button occurs in prior rivet button practices which employ fewer than four (4) steps.

Progressively increasing rivet button height, as carried out in prior practices, decreases sheet metal thickness at the closed end of the sheet metal rivet button which is used for forming the unitary rivet head. Each button-forming step in which rivet button height is progressively increased, FIGS. 3(*a*) through 3(*d*) progressively decreases the thickness of sheet at and near the closed end for the unitary button. The central portion at the closed end of the elongated rivet button height is subject to the largest strain-deformation due to progressive thinning of that sheet metal.

Relatively heavy starting thickness gauge sheet metals were thus required in the prior practices. For example, single-reduced flat-rolled steel of at least about seventy-five pounds per base box was required by a prior practice, as shown in FIGS. 3(*a*) through 3(*d*).

In brief, the prior practices depended on thicker starting gauges and generally lower tensile-strength rigid flat-rolled sheet metals. For example, single-reduced flat-rolled steel of about eight mils (0.008") to about nine mils (0.009") nominal thickness gauge, with tensile strength averaging about fifty to about sixty ksi, was used in prior practices for fabricating rivet buttons for container-closure structures.

Attempting to use lighter-gauge materials, such as double-reduced (DR) steel, of about fifty #/bb to about seventy #/bb resulted in cracking or splitting (as shown in FIG. 4) of surface metal at or about location 64 in the closed end of rivet button 66.

The present invention significantly limits strain-deformation in sheet metal which is relied on to form the rivet button. A major portion of desired rivet button height is achieved with only a minor decrease in thickness of that sheet metal for forming the rivet button. A rivet button, of more uniform thickness throughout its height than was previously available, is thus formed.

Figure 7:
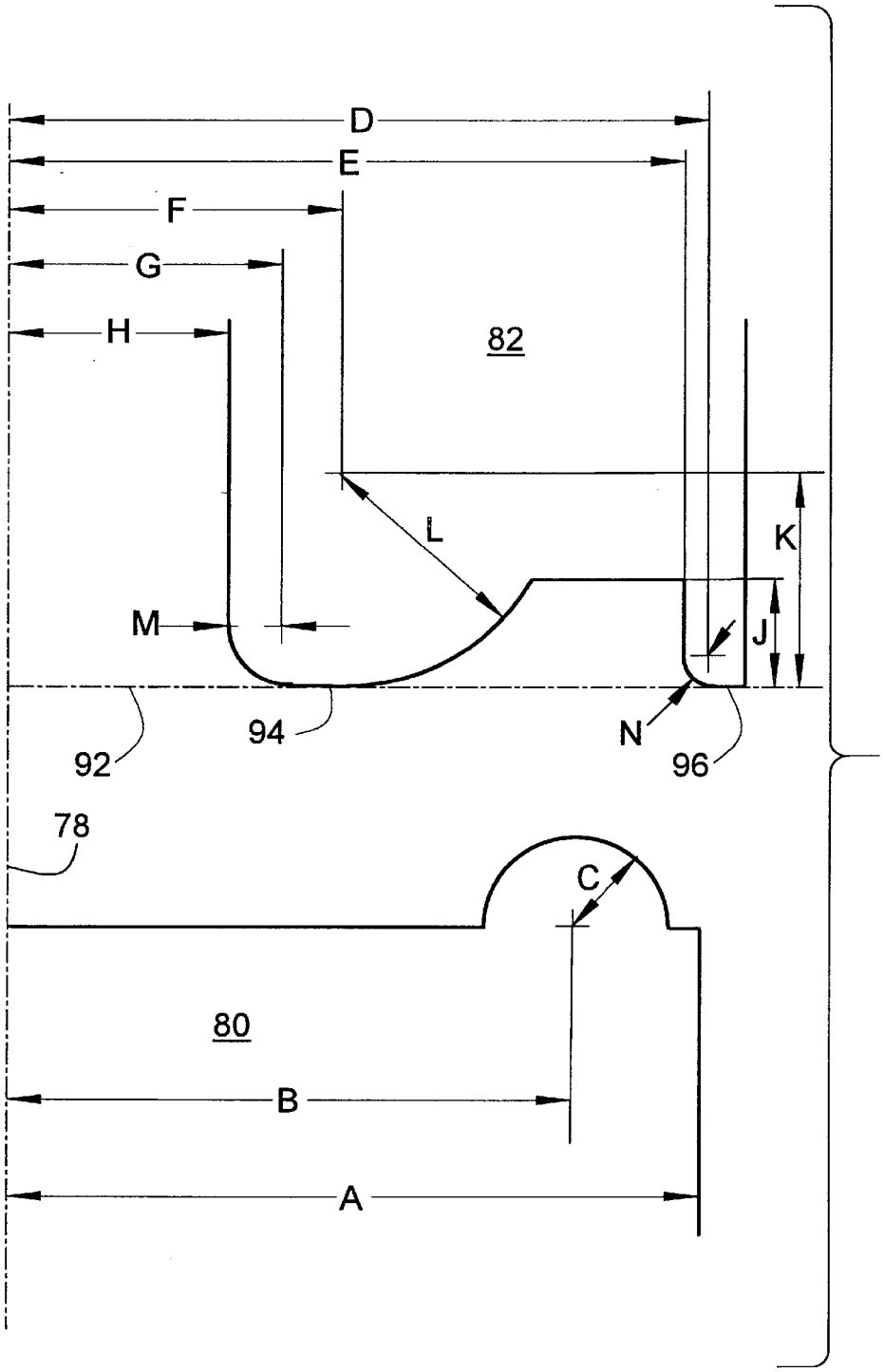
FIG. 7 is an enlarged cross-sectional elevational view of a portion of the tooling shown in FIG. 5, as located within the circle designated "FIG. 7", for describing curved-surface radii and dimensional relationships of such annular bead tooling.
Figure 8:
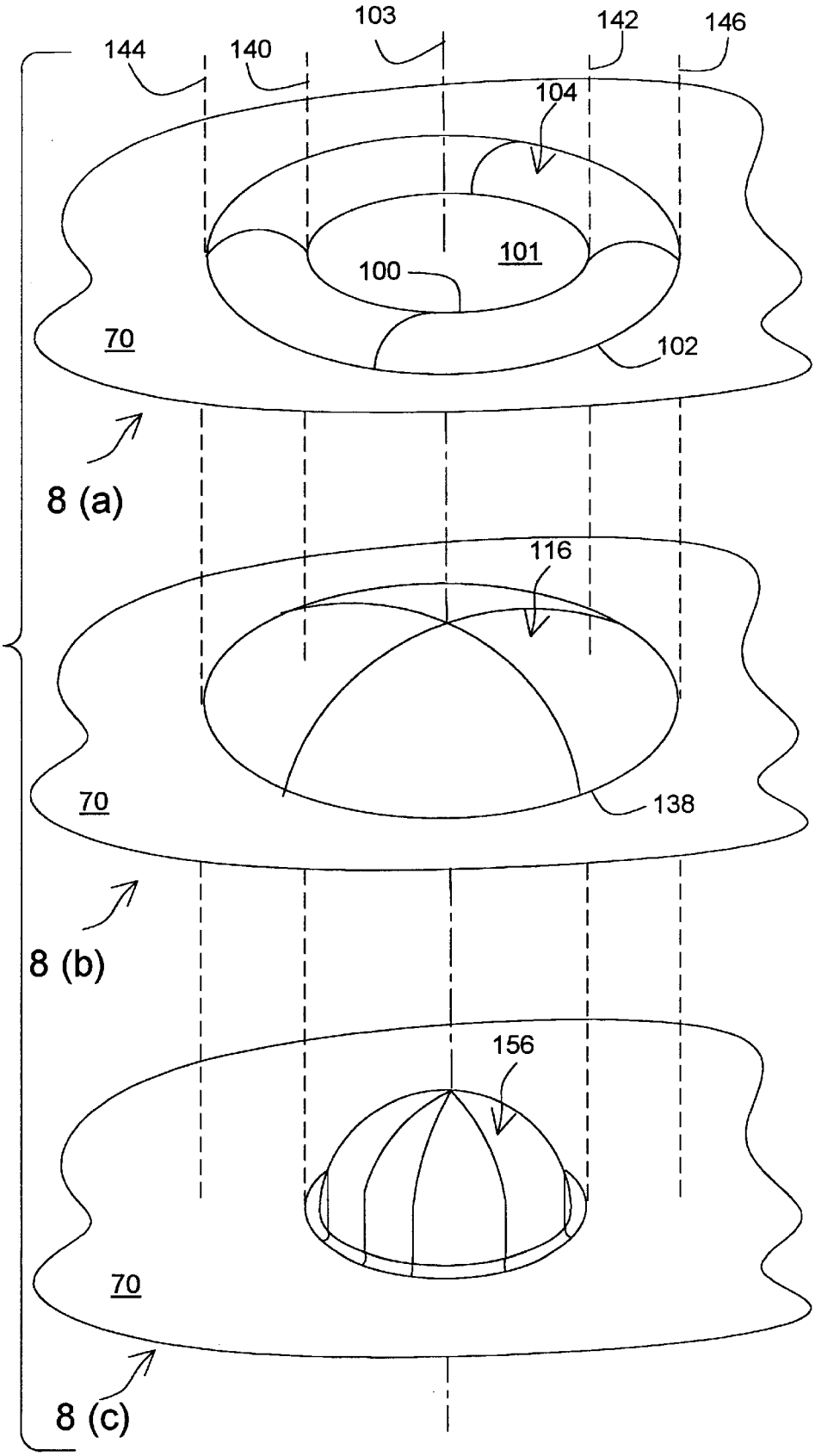
FIGS. 8(*a*) through 8(*c*) are perspective partial views of container-closure sheet metal for describing sequential processing steps of the invention for forming a rivet button.

Tooling (shown in FIGS. 5 through 7) for an initial processing step of the invention produces an annular bead, as shown in the perspective view of FIG. 8(*a*).

Such annular bead protrudes from a substantially-planar scored portion of sheet metal 70 (FIGS. 5, 6, 7 and 8); and is symmetrically disposed in relation to centrally-located axis 78 (shown in FIGS. 5 through 7) for relative movement of the tooling.

Linear direction of relative movement between tooling punch 80 and tooling die 82 (FIG. 5) is parallel to central axis 78. Arrow 84 indicates a direction of relative movement in which tooling punch 80 moves toward tooling die 82 during forming of the annular bead shown in FIG. 6.

Figure 5:
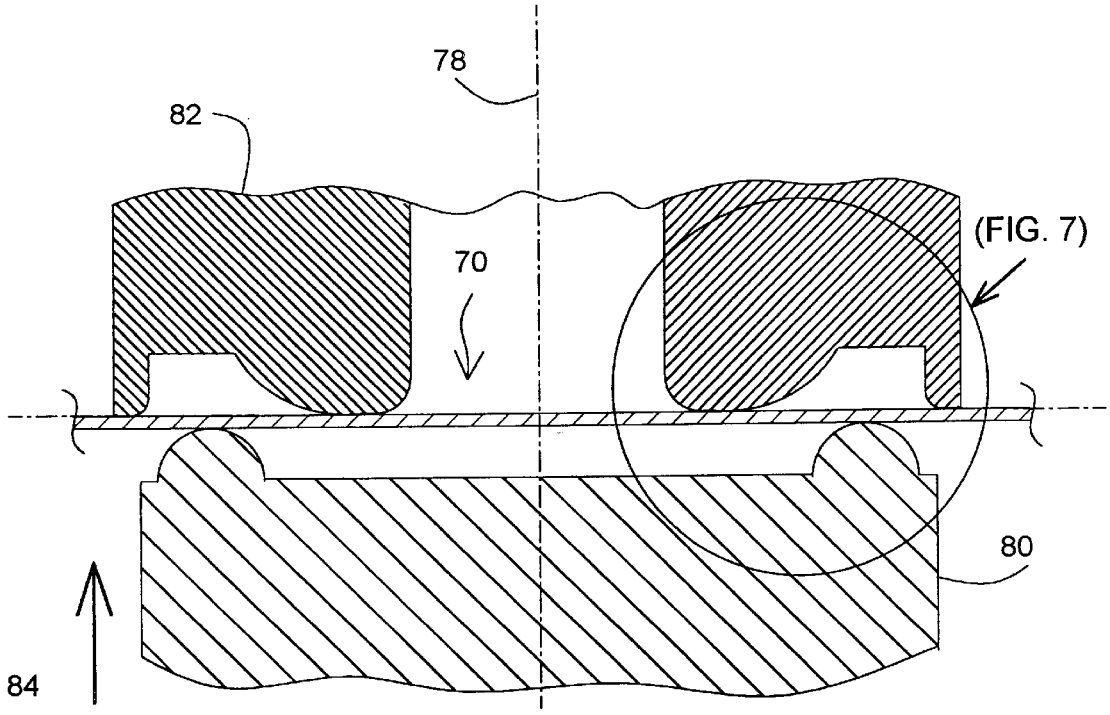
FIG. 5 is a cross-sectional elevational partial view for describing annular bead forming tooling of the invention for carrying out an initial step for improving fabricating of a rivet button from rigid flat-rolled sheet metal in accordance with the invention.
Figure 6:
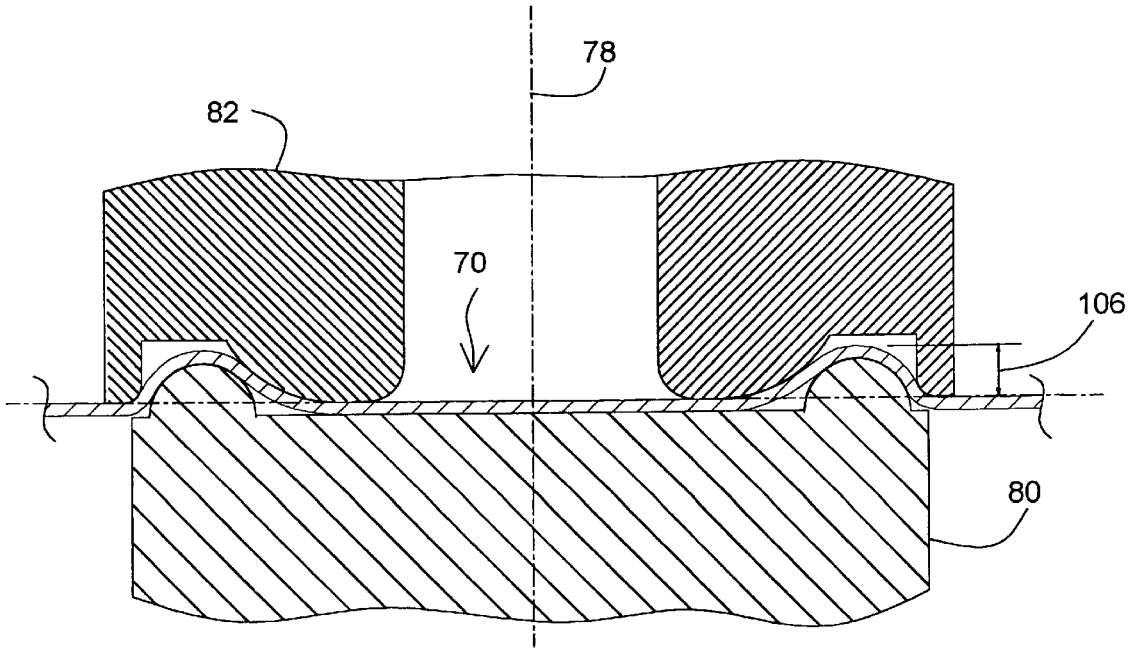
FIG. 6 is a cross-sectional elevational partial view for describing the action of, and positioning of, the tooling of FIG. 5 upon completing a protruding annular bead of the invention.

Locations for dimensional measurements of a specific embodiment of the tooling of FIGS. 5, 6 are set forth in an enlarged cross-sectional view of FIG. 7 (in which, for purposes of clarity, cross-sectional hatching has been omitted). Such enlarged cross section of the tooling for forming the annular bead is indicated in FIG. 5 by the circle designated "FIG. 7." Dimensions are referenced alphabetically to distinguish from numerical designations of tooling parts; such measurement data are set forth in TABLE I, following, under the heading *Annular Bead Tooling* (FIG. 7).

As indicated by FIG. 7, radial dimensions are measured from central axis 78 in a plane which includes such axis. Vertically-oriented dimensions are measured in a plane parallel to axis 78. Horizontally-oriented dimensions are measured in a plane perpendicular to axis 78, as depicted by interrupted line 92 of FIG. 7. Surfaces 94 and 96 (FIG. 7) of die 82 each contact plane 92. The radii of surfaces which are curvilinear, as seen in the cross-sectional view in FIG. 7 (such as radius "C"), are measured in the same plane which includes central axis 78, referred to above.

TABLE I

Annular Bead Tooling (FIG. 7)
End Closure Sheet Metal - 65#/bb Double Reduced Steel

| | Location | Dimension |
|---|---|---|
| Punch | A | 0.2255" |
| | B | 0.1850" |
| | C | 0.0305" |
| Die | D | 0.2300" |
| | E | 0.2200" |
| | F | 0.1100" |
| | G | 0.0910" |
| | H | 0.0710" |
| | J | 0.0350" |
| | K | 0.0700" |
| | L | 0.0700" |
| | M | 0.0200" |
| | N | 0.0100" |

The bead, formed by tooling described in relation to FIGS. 5–7, protrudes from the substantially-planar sheet metal 70, as indicated in one embodiment of the annular bead shown in perspective view of FIG. 8(*a*). Inner ring 100 (which circumscribes center panel 101) and outer periphery 102 are symmetrically disposed in relation to central axis 103 (FIG. 8). That is, inner ring 100 and outer periphery 102 of annular bead 104 are each, respectively, uniformly spaced radially from central axis 103.

Annular bead 104 protrudes toward the public side of substantially planar wall 70 of FIGS. 5, 6 and 8(*a*). An alternate direction of protrusion for bead 104 is made available by the invention, as described in relation to later tooling FIGS.

Sheet metal thickness of substantially-planar center panel 101 is not significantly decreased by forming annular bead 104. The objective is to substantially maintain initial thickness gauge of the sheet metal of center panel 101.

Referring to FIG. 8(*a*), outer ring 102 and inner concentric ring 100 of annular bead 104 are each located at the juncture of such protruding sheet metal of annular bead (104) with substantially-planar sheet metal 70. In practice of the invention, the radius of outer ring 102 is selected in a range from about two point two (2.2) to about two point six (2.6) times a desired rivet button radius [FIG. 8(*c*)] which is also the radial distance from central axis 103 to the outer surface of a cylindrical-configuration portion of the unitary rivet button being formed; such cylindrical portion comprises the outer surface of the stem of the later formed unitary rivet.

Inner ring 100 is selected to have a radius in the range of about one point five (1.5) to about one point nine (1.9) times the desired radius for the outer surface of such rivet button sidewall. Selection of a value from each of the above ranges should be made from a similar portion of each range. For example, if a value for the outer periphery 102 is selected to be two point three (2.3) (that is, at lower portion of the outer periphery range), a value of about one point six (1.6) (at the lower portion of the inner ring range) should be selected for the inner ring 100.

FIG. 6 depicts the positions of die 82 and punch 80, as annular bead 104 is being completed. The bead is displaced from the plane of the wall panel as indicated at 106; that displacement, as measured substantially midway between the two circular peripheries (100 and 102), is selected to be about point four (0.4) to about point six (0.6) times the difference in the radius dimensions of outer ring 102 and inner ring 100.

In a specific embodiment utilizing sixty-five pound/bb double-reduced flat-rolled steel, the radius for outer periphery 102 of annular bead 104 is selected to be about two point five (2.5) times rivet stem radius, and the radius for inner ring 100 is selected to be about one point eight (1.8) times rivet stem radius for a selected rivet button to be formed to provide a final rivet stem radius of about 0.09". The radius for the outer periphery is therefore about 0.225" (0.09" times 2.5); and, the radius for the inner ring is about 0.160" (0.09" times 1.8); the protruding displacement from the wall panel, at the apex of the annular bead, is about 0.0325" [0.5 times (0.225" minus 0.160")].

It should be noted that significantly smaller-diameter cylindrical portions of unitary buttons, for stems of unitary rivets, are available with teachings of the invention. The specific embodiment diameter dimension was chosen to approximate the 0.1875" diameter required by the prior practice with SR steel for economies of using installed equipment.

Figure 9:
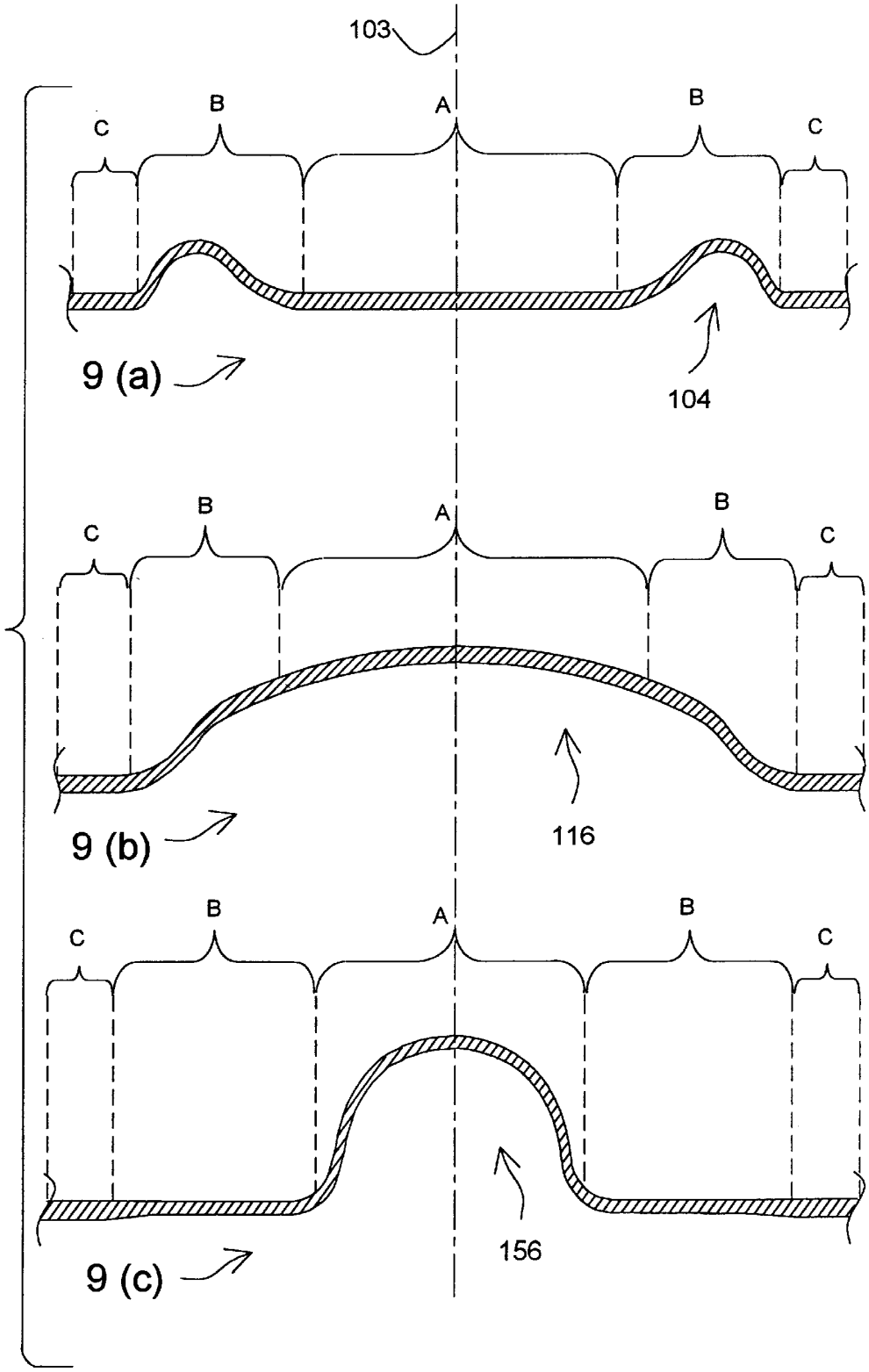
FIGS. 9(*a*) through 9(*c*) are schematic cross-sectional elevational profiles of the configurations of FIGS. 8(*a*) through 8(*c*), respectively, for indicating sheet metal thickness measurement locations for sequential processing configurations of the invention.

FIG. 9 presents cross-elevational profiles for indicating locations for measuring sheet metal thicknesses to indicate average thicknesses achieved by use of the tooling, respectively, of FIGS. 5–7, 10–13 and 14–16.

Alphabetical designations are used for indicating locations for thickness measurements for approximating average sheet metal thicknesses of three sheet metal locations; and average thicknesses are tabulated herein.

Starting thickness for nominal sixty-five pounds per base box DR flat-rolled steel measures about 0.0072". That sheet metal thickness is substantially uniformly maintained, with only an insignificant decrease (less than 1.5%) in thickness of the metal of center panel 101 in the first processing step.

Any significant thinning of sheet metal during the first processing step is substantially confined to the sheet metal which forms protruding annular bead 104 of FIG. 8(*a*); that metal is decreased in thickness an average of about twenty percent (to 0.0058") in forming annular bead 104.

The configuration and interaction of the tooling of FIGS. 5 and 6 eliminate any significant thinning of sheet metal radially outward of outer ring 102 of FIG. 8(*a*).

Slight non-symmetrical thinning in the sheet metal of the curved surface of annular bead 104 can be due to location factors. For example, if a portion of the annular bead metal is located adjacent to the periphery of an endwall panel, sheet metal characteristics at that peripheral location can differ slightly in relation to more radially-inwardly spaced locations. Such slight non-symmetry in metal of a portion of the annular bead does not significantly affect the average uniformity of sheet metal thickness provided for the rivet button.

TABLE II

Average Thickness Profile [FIG. 9(a)]

| Location | Approximate Sheet Metal Thickness |
|---|---|
| A | 0.0071" |
| B | 0.0058" |
| C | 0.0072" |

Figure 10:
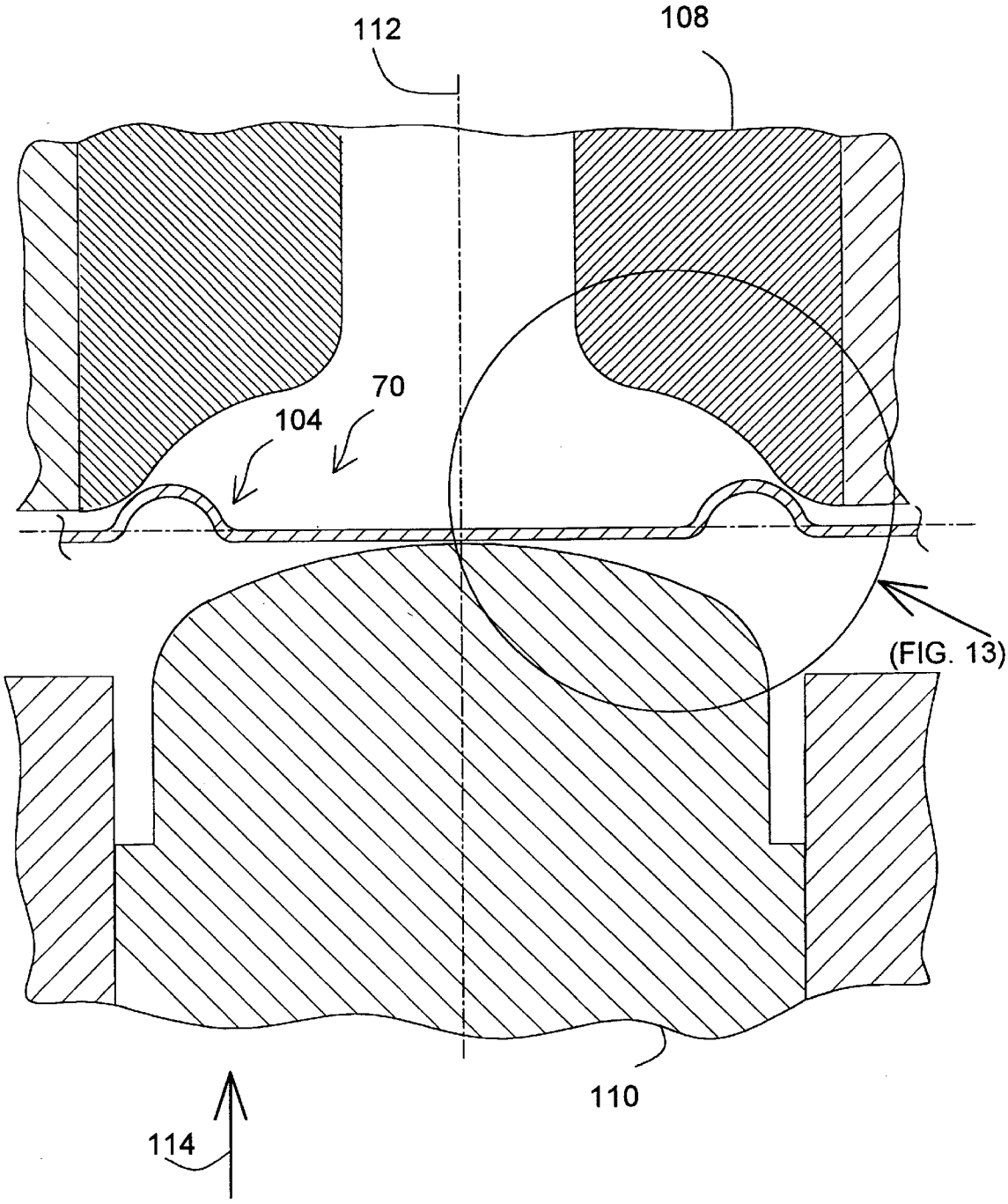
FIG. 10 is a cross-sectional elevational partial view of tooling of the invention for describing positioning of such tooling, with respect to the annular bead of FIG. 8 (*a*), for subsequently forming a large-diameter arch-shaped protrusion of the invention, shown in FIG. 8(*b*)
Figure 11:
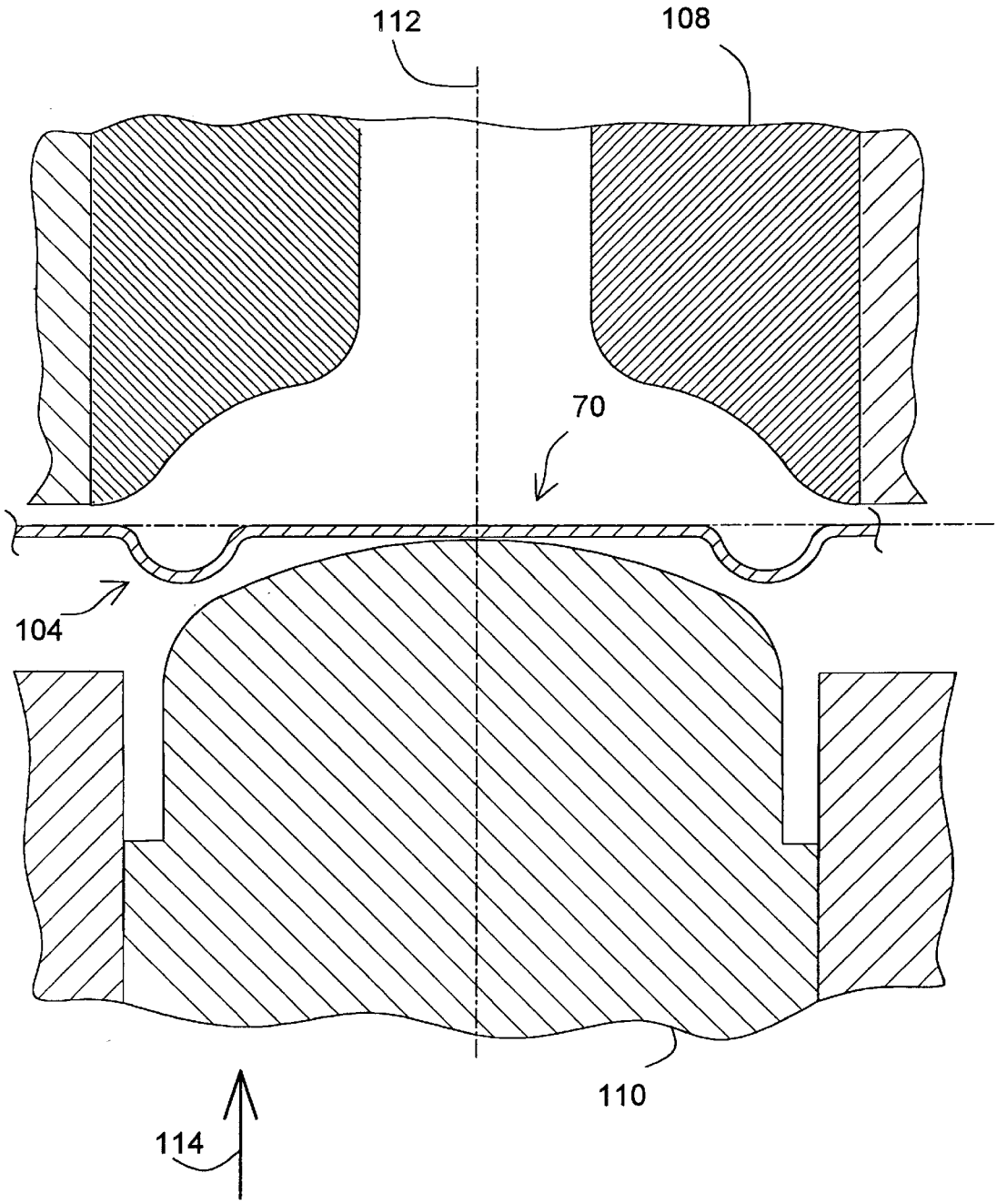
FIG. 11 is a cross-sectional elevational partial view of the tooling of FIG. 10, for describing an alternate-direction embodiment of the invention other than the direction of protruding of annular bead of FIG. 8 (*a*), available in accordance with the invention for forming such protrusion of FIG. 8(*b*)

The tooling of FIGS. 10 and 11, for a processing step of the invention sequential to such initial annular bead forming step, forms large-diameter arch-shaped protrusion 116 of FIG. 8(*b*); such configuration protrudes externally from the public surface side of sheet metal 70.

Sheet metal of center panel 101, and the sheet metal of annular bead 104, are positioned between die 108 and punch 110 of FIGS. 10 and 11. Centrally-located axis 112 of FIGS. 10–13 establishes the directional movements for die 108 and punch 110. During the forming action of such protrusion 116, the direction of movement of punch 110 is indicated by arrow 114 (FIGS. 10 and 11).

For purposes of forming large-diameter arch-shaped protrusion 116, annular bead 104 can protrude toward the "public side" or toward the "product side" of the container, as indicated by FIGS. 10 and 11, respectively. Either orientation (FIG. 10 or FIG. 11) performs satisfactorily, with the resulting protrusion and resulting sheet metal thickness being substantially the same.

Figure 12:
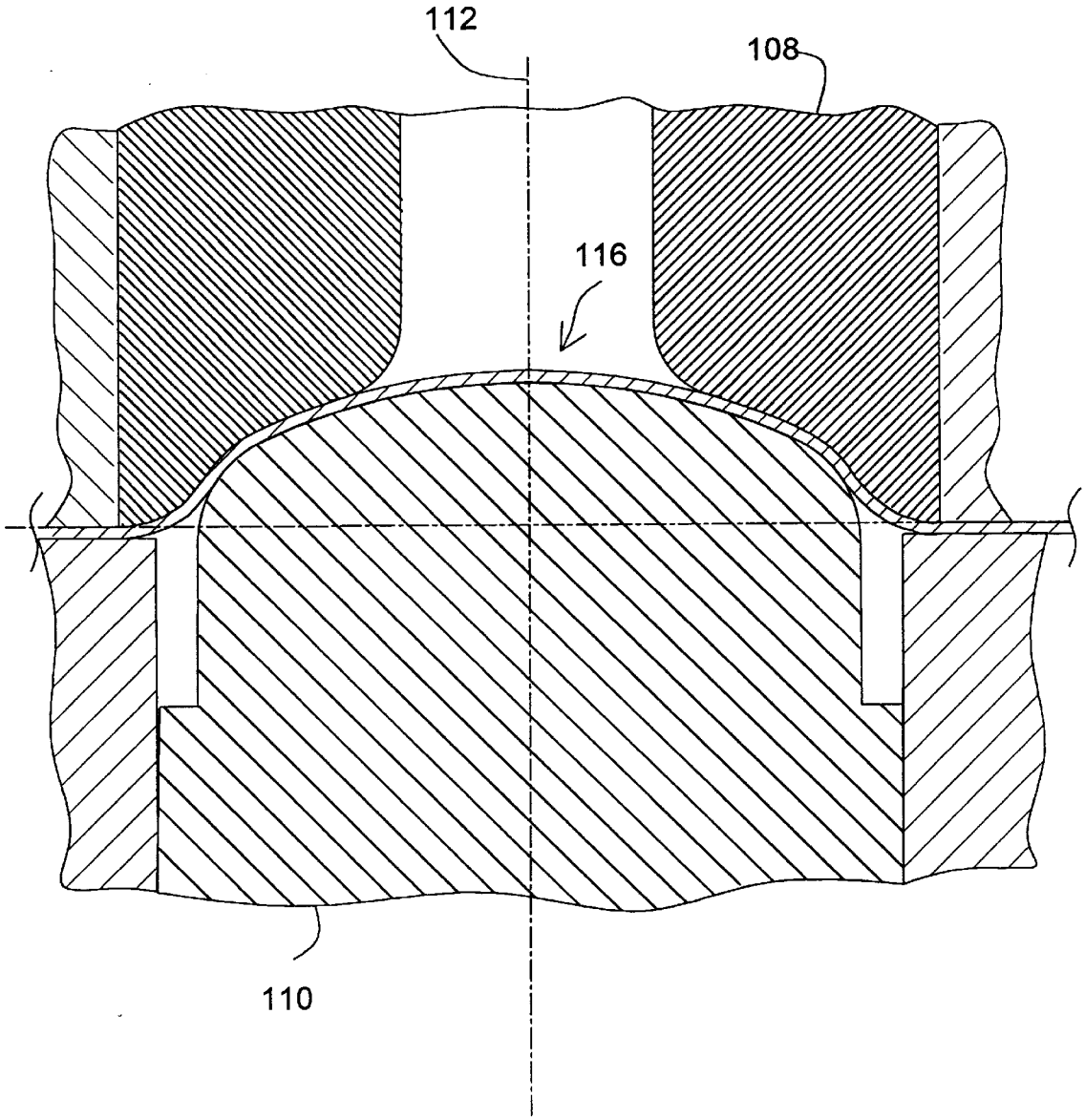
FIG. 12 is a cross-sectional elevational partial view of protrusion forming tooling of the invention, as shown in FIGS. 10 and 11, for describing positioning of such tooling for completing the configuration shown in perspective in FIG. 8(*b*)
Figure 13:
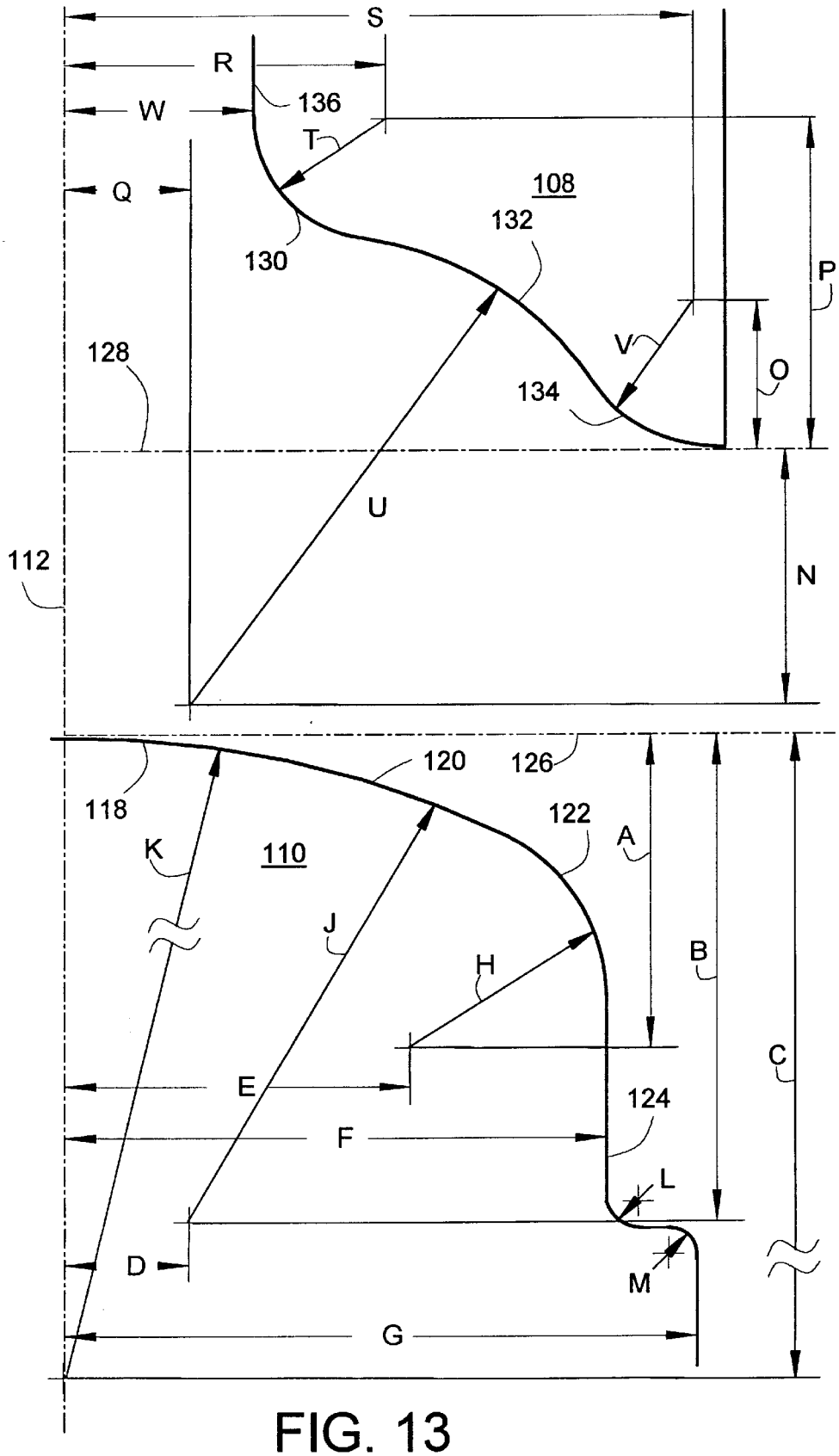
FIG. 13 is an enlarged cross-sectional elevational view of a portion of the tooling, within the circle designated "FIG. 13" in FIG. 10, for describing curved-surface radii and other dimensional relationships of tooling of the invention, for forming the configuration shown in FIG. 8(*b*)

The positioning of the tooling, after relative movement of die 108 and punch 110 upon completion of protrusion 116, is shown in FIG. 12; and, locations for dimensional measurements of the tooling are indicated in FIG. 13.

In the enlarged cross sectional view of FIG. 13, cross-sectional hatching has been omitted; radii for tooling transition zones, which are curvilinear in cross sectional view, and other dimensional relationships of a specific embodiment of the punch and die are set forth; alphabetical designations for measurements are used for purposes as stated earlier in relation to FIG. 7. Dimensions for the protrusion shaping tooling are set forth in Table III (below). Such measurement locations of such enlarged cross section of FIG. 13 are taken within the circle designated "FIG. 13" shown in FIG. 10.

Compound-curvature surfaces of the tooling are surfaces which are curved whether shown in a cross-sectional plane which includes central axis 112, or in a cross-sectional plane which is perpendicularly transverse to central axis 112. Thus, in any cross section, compound-curvature surfaces are represented by a curved line; whereas, single-curvature surfaces, such as a cylindrical wall, are represented by a straight line in a cross-sectional view which includes a central axis, such as 112 of FIGS. 10–13.

TABLE III

Large-Diameter Protrusion Tooling (FIG. 13)
End Closure Sheet Metal -- 65#/bb Double-Reduced Steel
Rivet Button Radius -- 0.0925" (outside dimension)

| | Location | Dimension |
|---|---|---|
| Punch | A | 0.1139" |
| | B | 0.1767" |
| | C | 0.3750" |
| | D | 0.0450" |
| | E | 0.1250" |
| | F | 0.1950" |
| | G | 0.2285" |
| | H | 0.0700" |
| | J | 0.1717" |
| | K | 0.3750" |
| | L | 0.0100" |
| | M | 0.0100" |
| Die | N | 0.0920" |
| | O | 0.0550" |
| | P | 0.1215" |
| | Q | 0.0450" |
| | R | 0.1160" |
| | S | 0.2283" |
| | T | 0.0450" |
| | U | 0.1800" |
| | V | 0.0550" |
| | W | 0.0710" |

The compound-curvature upper surface portion of tooling punch 110 of FIGS. 10, 11, which is curvilinear in cross-sectional view, is machined to present arc-shaped surfaces which are formed about differing radii. Half of that compound-curvature surface of punch 110 shown in FIG. 13 comprises arc-shaped surfaces 118, 120 and 122 (a mirror image half exits on the opposite side of central axis 112). Each such surface (118, 120 and 122) is formed about a differing radius (designated, respectively, K, J, H).

Arc surface 118 (Radius K) extends through central longitudinal axis 112 to intersection with arc surface 120 which is formed about Radius J. Arc surface 120 then extends to intersect arc surface 122 which is formed about Radius H. Arc surface 122 then extends to intersection with substantially cylindrical sidewall surface 124. Sidewall 124 is substantially uniformly spaced (radial dimension F) from central longitudinal axis 112.

Referring to punch 110 of FIG. 13, vertically-oriented lines A, B and C measure an axial dimension from a horizontally-oriented plane represented by interrupted line 126. That plane is perpendicularly transverse to axis 112 at a location where upper arc surface 118 intersects axis 112.

Referring to die 108 of FIG. 13, vertically-oriented dimensions N, O and P of die 108 are measured from a horizontally-oriented plane represented by interrupted line 128, which is also perpendicularly transverse to central axis 112.

The compound-curvature surfaces of die 108 (in cross-sectional view) are represented by arcs 130, 132 and 134; each surface is formed about its respective radius T, U and V. Such compound-curvature surfaces 130, 132 and 134 define the interior of die 108 which interacts with the previously-described curved surfaces of punch 110 to form the sheet metal, as shown in perspective in FIG. 8(*b*), and shown in cross-sectional profile in FIG. 9(*b*).

The surface of arc portion 134 (Radius V) of die 108 (which is curvilinear in the cross-sectional view of FIG. 13) extends from the plane depicted by interrupted line 128 to intersection with the arc-shaped surface 132 (Radius U). Compound-curvature arc surface 132 then extends to intersection with arc surface 130 (Radius T), which then extends to intersection with a cylindrical configuration surface indicated in cross section by straight line 136; cylindrical sidewall 136 is symmetrical with central longitudinal axis 112.

In the schematic presentation of FIG. 13, the dimensional radius lines designated "IC" and "K" are each interrupted along their length in order to better present the interacting curvilinear working surfaces of die 108 and punch 110 in a single figure. The full length of each radius "C" and "K" can be better visualized from FIG. 10; and the full radii dimensions of "C" and "K" are presented in Table III.

The intermediate processing step of FIGS. 10–13, disposes the sheet metal which previously comprised the curved-surface sheet metal of annular bead 104 of FIG. 8(*a*) to comprise the peripherally-located portion of arch-shaped protrusion 116; and, the sheet metal of previous center panel 101 comprises the centrally-located portion of such protrusion 116.

The average thickness of sheet metal of annular bead 104 is not significantly changed during forming of large-diameter protrusion 116 [see FIG. 9(*b*) and TABLE IV]. The centrally-located sheet metal of protrusion 116, which had comprised sheet metal of center panel 101, is decreased in thickness about five percent during forming of such protrusion.

For identification of locations of portions of the sheet metal in three processing steps of the embodiment being presented, reference is made to FIGS. 8 and 9. During the processing steps forming the configuration of FIGS. 8(*a*), (*b*) and (*c*), a cross-sectional location indication of the sheet metal of annular bead 104 of FIG. 8(*a*) can be approximated in subsequent FIGS. 8(*b*) and (*c*) by using the vertically-oriented interrupted lines 140, 142 and interrupted lines 144, 146; each pair identified, respectively, contacts with inner ring 100 and outer ring 102 in FIG. 8(*a*). Extending those vertically-oriented interrupted lines (140, 142 and 144, 146) from FIG. 8(*a*) to FIG. 8(*b*) approximates the location of peripherally-located sheet metal of protrusion 116, which substantially comprises the same metal as that disposed in annular bead 104 of FIG. 8(*a*).

In the cross-sectional elevational profile of sheet metal of arch-shaped protrusion 116 of FIG. 8(*b*) (as formed by the tooling of FIGS. 10–13), those approximate locations correspond, as closely as practical, with the alphabetical reference locations for measurements of sheet metal thicknesses set forth in FIG. 9. The changes in area of the sheet metal of annular bead 104, and any slight changes which may occur during forming of the peripheral sheet metal of protrusion 116 of FIG. 8(*b*), help to avoid substantial strain-deformation of the centrally-located sheet metal. Establishing precisely corresponding locations of portions of the sheet metal in FIGS. 8 and 9 would be difficult; estimated locations with average thickness measurements are set forth in TABLE IV.

The functioning of the tooling in forming the desired unitary rivet button is not affected by changes in such peripheral metal, since the disposition of rivet button metal is protected in FIGS. 8(*a*) and 8(*b*) by such peripheral metal.

The sheet metal comprising the centrally-located portion of arch-shaped protrusion 116 corresponds to the sheet metal of "center panel" 101 which is radially inward of inner ring 100 in FIG. 8(*a*). During forming of protrusion 116 of FIG. 9(*b*), average sheet metal thickness in such centrally-located portion is decreased less than about five percent during forming of protrusion 116 (from 0.0071" to about 0.0068").

Average thickness of peripheral area sheet metal of arch-shaped protrusion 116 in FIG. 9(*b*) is not changed significantly by such second processing step, as indicated by comparison of TABLE II (above) with TABLE IV (below).

TABLE IV

Average Thickness Profile [FIG. 9(b)]

| Location | Approximate Sheet Metal Thickness |
|---|---|
| A | 0.0068" |
| B | 0.0058" |
| C | 0.0072" |

Prior practices for forming a unitary rivet button, for an easy-open rigid flat-rolled sheet metal end closure, increased the height of sheet metal by decreasing thickness of sheet metal for the rivet button. Sheet metal at the center of the crown portion was decreased by each step to increase sheet metal height. Thus, the requirement for a heavy starting thickness gauge for the sheet metal of prior practice, such as at least about seventy-five pound per base box SR flat-rolled steel.

In contrast to prior practices, a major portion (about 70% to about 80%) of desired rivet button height is achieved in forming the arch-shaped protrusion 116, with only minor decrease in average thickness of less than about five percent, in sheet metal for the rivet button.

Figure 14:
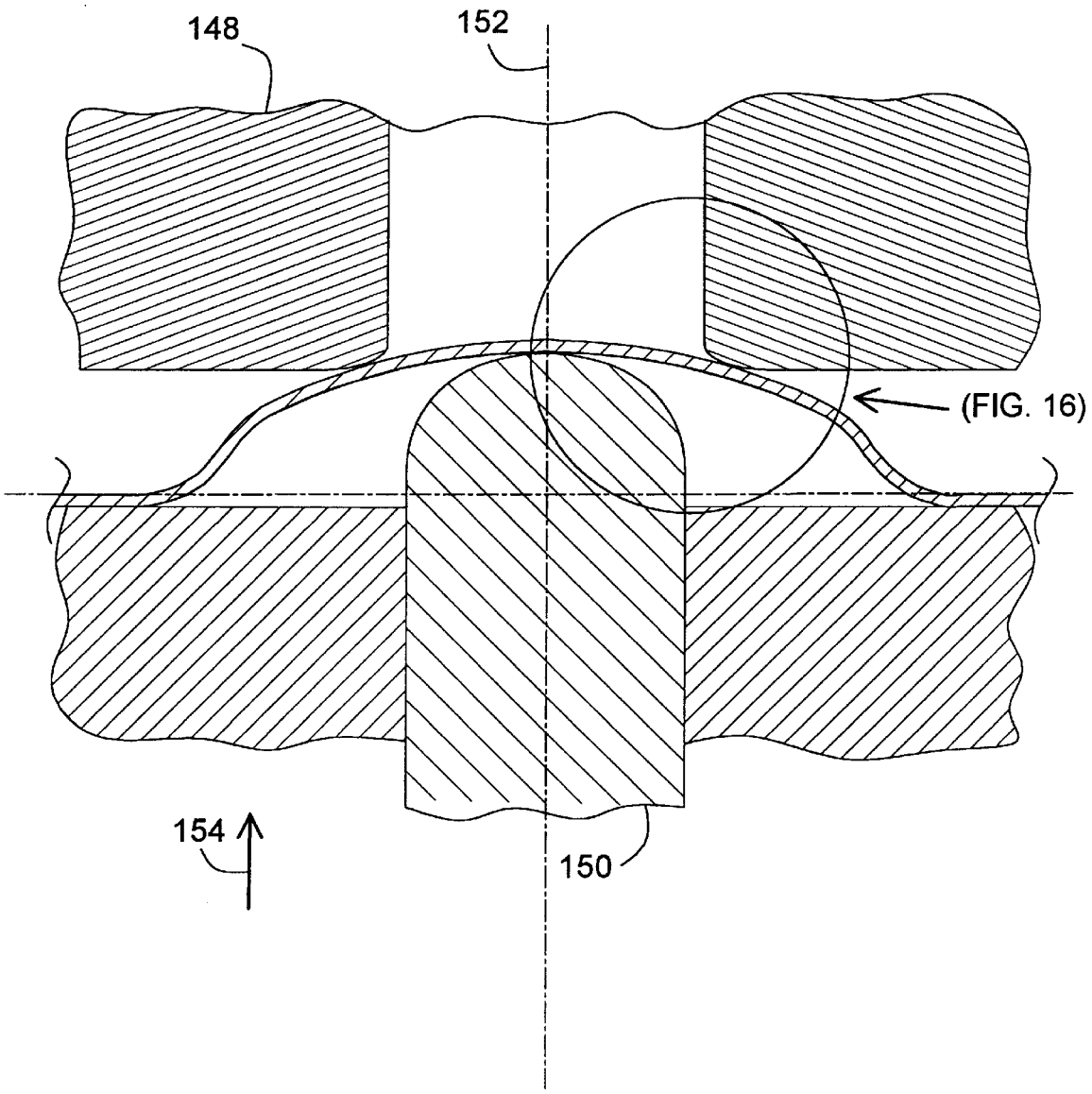
FIG. 14 is a cross-sectional elevational partial view for describing tooling of the invention for forming the rivet button shown in perspective in FIG. 8(*c*), and for describing positioning of such tooling with respect to the sheet metal configuration formed by the tooling of FIG. 12.
Figure 15:
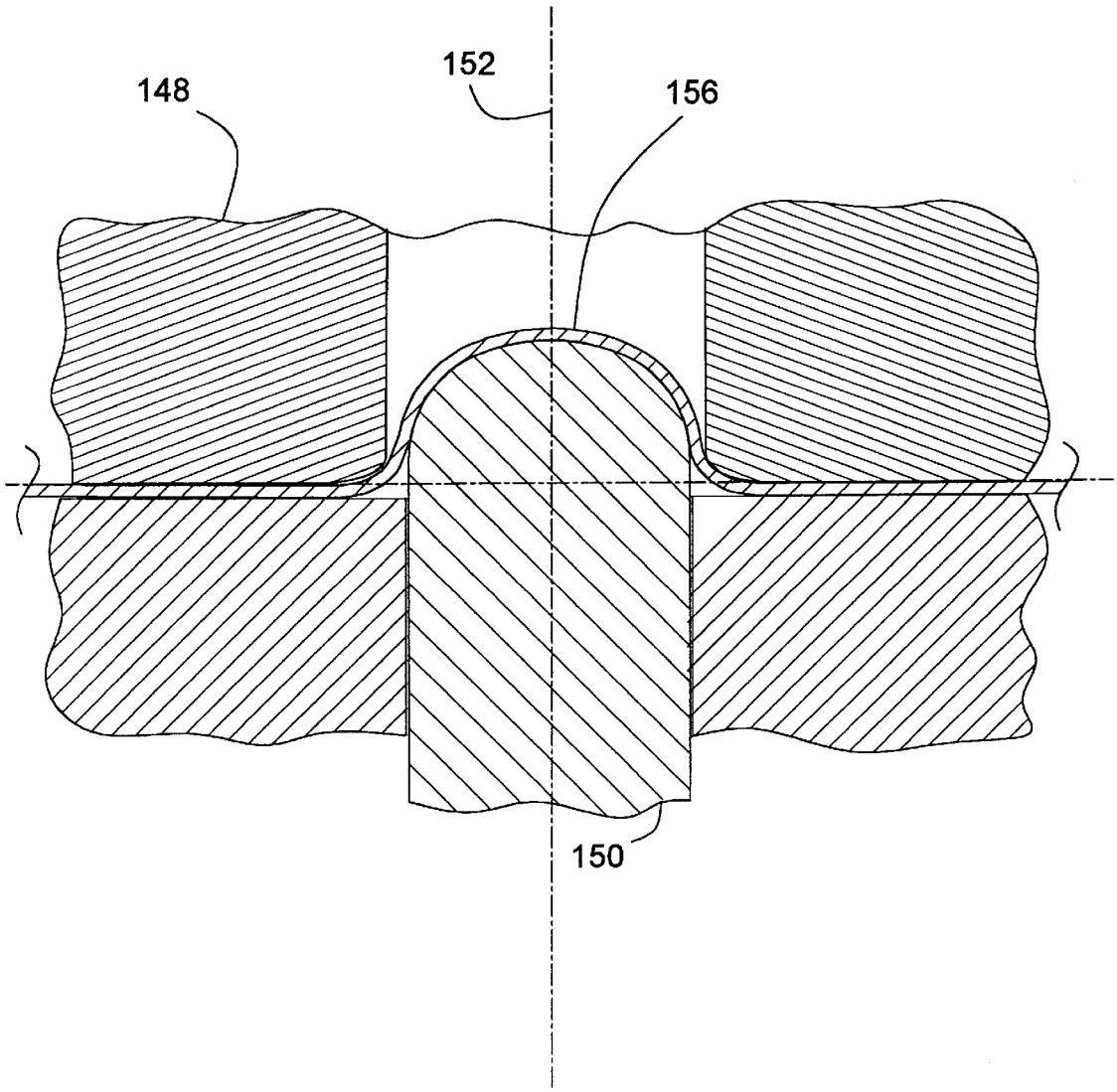
FIG. 15 is a cross-sectional elevational partial view of tooling of FIG. 14 for describing processing of sheet metal to form the unitary rivet button of the invention shown in perspective in FIG. 8(*c*)
Figure 16:
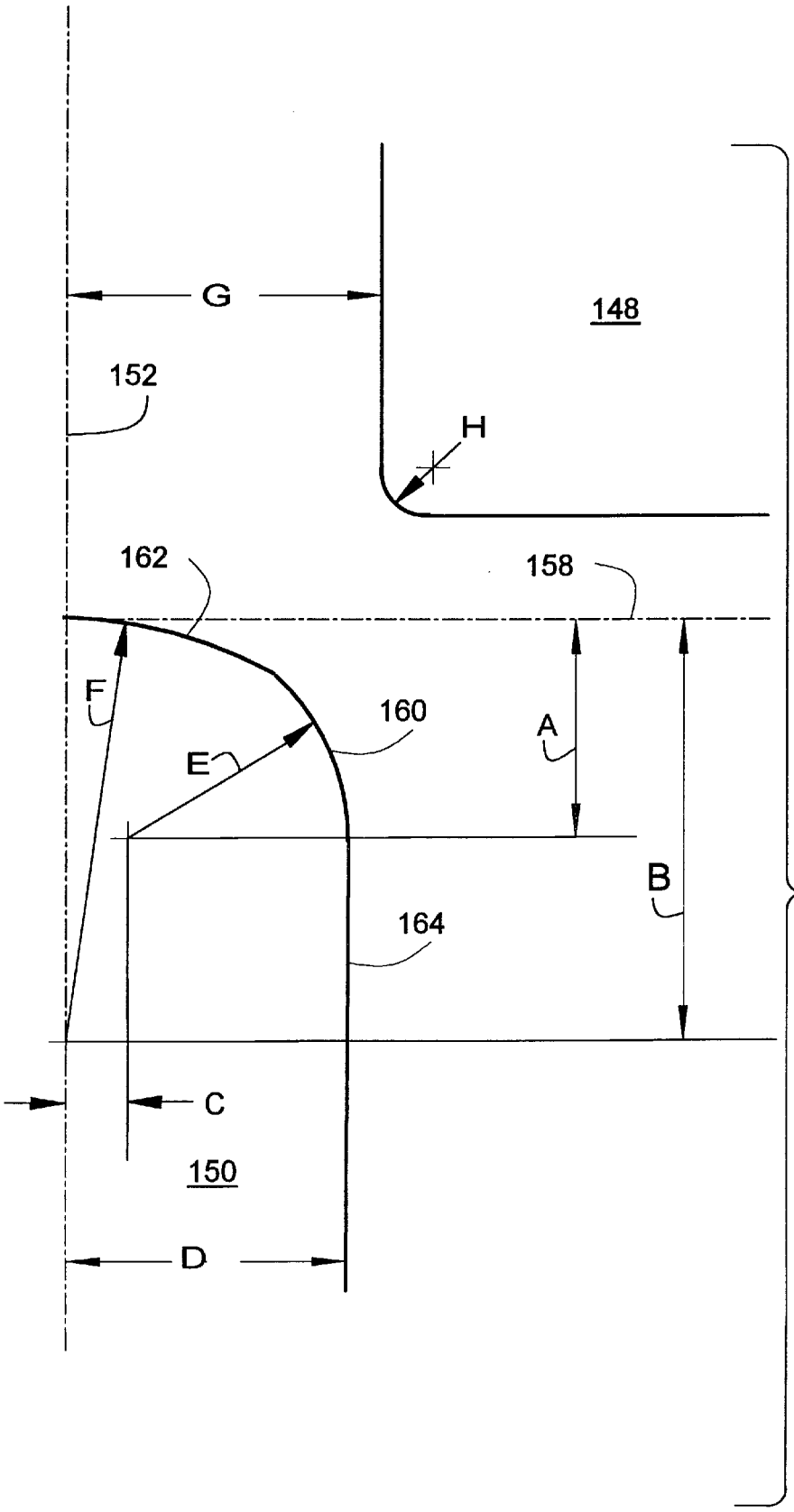
FIG. 16 is an enlarged cross-sectional elevational view of a portion of rivet button forming tooling of the invention, as located within the circle designated "FIG. 16" in FIG. 14.

Tooling apparatus of FIGS. 14–16 is used for forming the rivet button of FIG. 8(*c*) from that centrally-located sheet metal of protrusion 116, which has a substantially uniform thickness within about five to six percent of starting sheet metal thickness.

That significant portion (about 70–80%) of elongated rivet button height is established during forming of the centrally-located portion of protrusion 116 is seen in FIG. 14. Establishing the remaining rivet button height from that centrally-located portion, and returning peripheral metal to the plane of sheet metal 70 [(FIG. 8(*c*)], is carried out by the tooling of FIGS. 14, 15.

Die 148 and punch 150 of FIG. 14 move, relative to each other, parallel to central axis 152; during rivet button forming action, the direction of such movement for punch is indicated by arrow 154. Button-forming die 148 moves sheet metal onto punch 150, drawing sheet metal of the centrally-location portion of protrusion 116 into the draw die cavity (as shown in FIG. 15) and forming rivet button 156 of FIG. 8(*c*).

Locations for the dimensional measurements of the button-forming tooling of the specific embodiment are indicated in an enlarged cross-sectional view, of FIG. 16 (in which cross-sectional hatching has been omitted for purposes of clarity). The area of the tooling used for indicating locations for measuring dimensions is shown in FIG. 14 by a circle designated FIG. 16. Tooling measurements are set forth in Table V.

TABLE V

Rivet Button Tooling (FIG. 16)
End Closure Sheet Metal - 65#/bb Double Reduced Steel
Rivet Button Radius - 0.0925" (outside dimension)

| | Location | Dimension |
|---|---|---|
| Punch | A | 0.0678" |
| | B | 0.1250" |
| | C | 0.0180" |
| | D | 0.0830" |
| | E | 0.0650" |
| | F | 0.1250" |
| Die | G | 0.0925" |
| | H | 0.0150" |

In FIG. 16, interrupted line 158 represents a plane, which is perpendicularly transverse to central longitudinal axis 152 and intersects axis 152 at the geometric center of the compound-curvature portion along the longitudinal centrally-located axis 1–3 of rivet button 156.

That compound-curvature surface of rivet button punch 150, which is curvilinear in cross section as shown in FIG. 16, is defined by arc-shaped surfaces 160 and 162. Each is formed about a radius of differing length; radii E and F, respectively. Rivet button punch sidewall 164 is substantially cylindrical in axial cross section and is in symmetrical relationship with tooling central axis 152.

A mirror image of those surfaces exists on the opposite side of central axis 152, as shown in tooling FIGS. 14, 15. The surface of the centrally-located arc 162 (Radius F) extends through central axis 152 to the surface of arc 160 (Radius E); and, the surface of arc 160 extends from that intersection, to the cylindrically-shaped sidewall surface 164, which is symmetrically spaced from axis 152.

During draw-forming of button 156, curved surface portions (160, 162) of punch 150 act on the centrally-located sheet metal so as to draw that sheet metal into die cavity "G" (FIG. 16). The die cavity entrance surface is defined by radius "H" of FIG. 16. Such curvilinear surfaces and dimensions are selected so that any decrease in average thickness of the sheet metal of the centrally-located portion of FIG. 9(*b*), formed during the second processing step, is controllably limited, during draw forming of rivet button 156, from that centrally-located sheet metal. Such decrease in thickness of that sheet metal during such third processing step is substantially uniform, and is limited to an average decrease in the range of about 1.5% to about 17.5%.

Maintaining such rivet button sheet metal thickness avoids rupture of sheet metal when a thinner starting thickness gauge is selected while maintaining rivet button sidewall strength to provide desired columnar strength in the rivet stem during subsequent forming of a unitary rivet.

FIG. 8(*c*) presents a perspective view of rivet button 156, with vertically-oriented interrupted lines 140, 142 and 144, 146 [designated above in FIG. 8(*a*)] approximately correlating portions of the sheet metal which form the rivet button of the invention. The thickness profile views of FIGS. 9(*a*) through 9(*c*) approximate locations of sheet metal portions in each step, and average thicknesses at those respective locations are set forth in earlier TABLES II and IV, and following TABLE VI.

Sheet metal of center panel 101, radially inward of inner ring 100 of annular bead 104 of FIG. 8(*a*), comprises sheet metal of the centrally-located portion of arch-shaped protrusion 116 of FIG. 8(*b*); and, in the button-forming step, that sheet metal comprises the sheet metal from which rivet button 156 is formed.

Sheet metal of annual bead 104, as seen in FIG. 8(*a*) [at B in FIG. 9(*c*)] comprises the sheet metal of the peripheral portion of protrusion 116 of FIG. 8(*b*) at B in FIG. 9(*b*). And, in FIG. 8(*c*), it can be seen that such peripheral sheet metal is returned, during the rivet button forming step, to the substantially-planar sheet metal wall 70 which circumscribes rivet button 156.

The thickness profile data of the specific embodiment of the above-described process steps and apparatus of the invention utilized double-reduced flat-rolled steel having a nominal starting thickness gauge of about sixty-five #/bb, (about seven point two mils, 0.0072"); and provides a rivet button of more uniform thickness gauge, throughout its configuration, than was previously available.

Sheet metal of center panel 101 which is radially inward of inner ring 100 of bead 104 [FIG. 8(*a*)] has an average thickness of about 0.0071"; that sheet metal is decreased substantially uniformly less than about five percent (5%) to an average thickness of about 0.0068" during forming of arch-shaped protrusion 116 of FIG. 9(*b*).

The tooling of FIGS. 14 and 15 accomplishes desired rivet button height while substantially limiting decrease in thickness of such previous centrally-located portion of protrusion 116 to about seventeen and a half percent (17½%).

TABLE VI

Average Thickness Profile [FIG. 9(c)]

| Location | Approximate Sheet Metal Thickness |
|---|---|
| A | 0.0056" |
| B | 0.0058" |
| C | 0.0072" |

Figure 17:
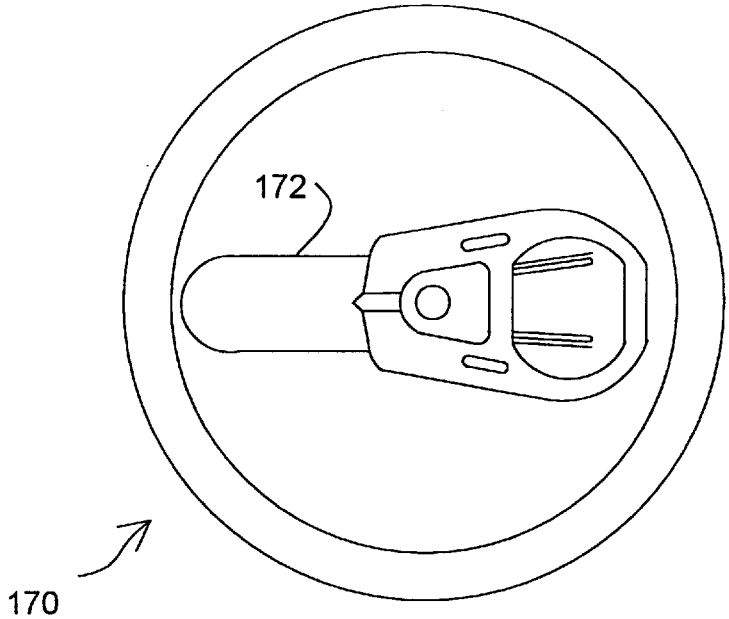
FIG. 17 is a top plan view for describing a circular-configuration easy-open pour-feature end closure, with integral opener secured by forming a unitary rivet button, such as shown in FIG. 15, into a unitary rivet of the invention, such as shown in cross section in FIG. 2.
Figure 18:
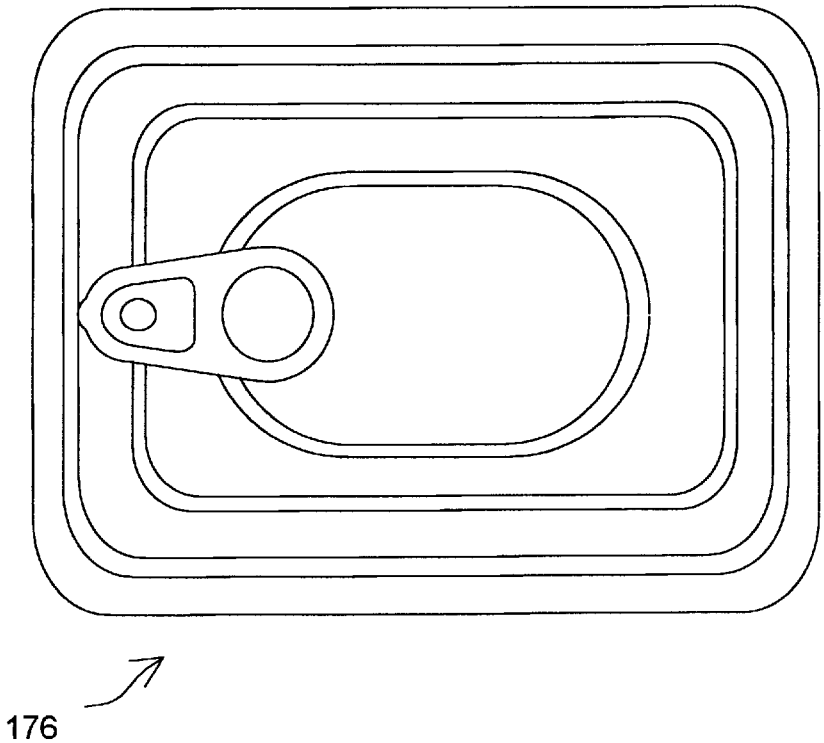
FIG. 18 is a top plan view for describing a rectangular-configuration full-panel easy-open end closure, with integral opener secured by forming a unitary rivet button, such as shown in FIG. 15, into a unitary rivet of the invention, such as shown in cross section in FIG. 2.

The invention can be carried out, for food or beverage use, on circular or non-circular sheet metal end closures for use on cylindrical or non-cylindrical containers, respectively. Unitary rivet button and unitary rivet fabrication, as taught herein, can be carried out for example on easy-open pour-feature end closures of the type shown at 170 in FIG. 17, which includes scored pour opening 172 (as described in more detail in copending and co-owned U.S. patent application Ser. No. 08/753,269, filed Nov. 22, 1996, now U.S. Pat. No. 5,813,811, which is included herein by reference); or, such rivet button and rivet fabrication can be carried out on full-open convenience-feature closures of non-circular configuration, such as shown at 176 in FIG. 18, including a full-open convenience-feature which enables removal of solid-pack contents in a single piece, as described in more detail in co-owned U.S. Pat. No. 5,217,134 (which is included herein by reference).

Aluminum alloy flat-rolled sheet metal of the 5000 H-19 Series is marketed as "Aluminum Rigid Container Sheet"; aluminum alloys 5042 H-19 and 5302 H-19 are marketed for easy-open food can ends, and 5182 H-19 is marketed for beverage can ends.

Such aluminum rigid container sheet for food cans has a thickness gauge of about 0.008" and a tensile-strength of about fifty-two ksi; 5182 H-19 for beverage cans has a thickness gauge of about 0.009" and a tensile-strength of about sixty-two ksi; each can benefit from the teachings of the present disclosure.

Each can take advantage of the substantially uniform sheet metal thickness taught herein to provide better performing unitary rivet buttons and unitary rivets. Such aluminum alloys for food can ends, in particular, can benefit from a decrease in rivet button height, rivet button diameter and the surface area of the rivet head, while maintaining substantially the same sheet metal thickness gauge previously used. With substantially uniform thickness sheet metal, the longitudinal height of the elongated rivet button can be decreased, as the rivet head for aluminum alloy food can ends is decreased from the diameter presently used of 0.26" to about 0.27". Available use of a narrower diameter stem, along with such decrease in rivet head diameter, facilitates easy-open features.

Double-reduced (DR) flat-rolled steel can stock with temper designation of DR-8 and tensile-strengths of about seventy-five ksi to about eighty ksi, used with teachings of the invention, can be selected with a starting thickness gauge in the range of about fifty #/bb (0.0055") to about seventy #/bb (0.0077"). Rivet button diameter can be decreased to about point one nine inch (0.19").

Rigid flat-rolled steel of lower tensile strength also benefits from the rivet button forming teachings of the invention. For example, single-reduced flat-rolled steel, by avoiding the progressive decrease in thickness steel gauge at the closed end in prior practices for button formation, is provided with more uniform metal thickness for the unitary rivet button and unitary rivet. SR flat-rolled steel with a tensile-strength of about fifty ksi to about sixty ksi can be used from slightly above seventy pounds per base box (70 #/bb) to about eighty-five pounds per base box; the diameter of the rivet button and rivet stem can be decreased from the present mandatory three-sixteenths inch; and the rivet head diameter can be decreased from the present diameter of about five thirty-seconds of an inch.

Flat-rolled steel for use in the invention is preferably electrolytically plated with metallic corrosion protection, such as tin, chrome-chrome-oxide, or NiZN, followed by a polymeric material with organic lubricant coating before fabrication. Aluminum alloys for easy-open ends are spray-coated with a polymeric material before fabrication.

While specific dimensional values, gauges, materials and steps have been set for purposes of describing concepts of the invention, it is to be understood that, in the light of the above teachings, those skilled in the art can modify those specifics without departing from the inventive concepts taught herein. Therefore, in determining the scope of the present invention, reference shall be made to the scope of the appended claims.

We claim:

1. Process for forming an elongated unitary rivet button of selected longitudinal height from substantially-planar container closure sheet metal, for subsequent conversion into a unitary rivet for securing a convenience-feature on an external surface of a scored portion to be severed from such sheet metal by such opener, comprising (A) providing rigid flat-rolled sheet metal can stock of preselected thickness gauge, between opposed substantially-planar surfaces, for securing a convenience-feature opener by converting a unitary rivet button formed in such scored portion into a unitary rivet;

(B) displacing sheet metal from such substantially-planar scored portion by forming a unitary annular bead, with sheet metal between an outer periphery ring and a concentric inner ring of such bead protruding from a substantially-planar surface of such scored portion, such annular bead being circular, in plan view, and
symmetrical with relation to a centrally-located axis which is perpendicularly-transverse to such sheet metal plane, with
such annular bead circumscribing a substantially-planar center panel located radially inward of such concentric inner ring,
such center panel having a geometric center which is coincident with intersection of such centrally-located axis for such annular bead, then (C) displacing sheet metal of such substantially-planar center panel and sheet metal of such protruding annular bead, so as to form a large-diameter protrusion in which such large diameter is centered on such centrally-located axis,
such protrusion having an arch-shaped configuration in a cross-sectional plane which includes such centrally-located axis, with sheet metal, centrally-located of such arch-shaped protrusion, establishing a major portion of the desired longitudinal height for such unitary rivet button, at its closed end,
such protrusion having an outer periphery established substantially by such outer ring of such annular bead of step (B), and
a centrally-located compound-curvature portion substantially comprising sheet metal from such center panel of step (B); and, then, (D) forming such centrally-located sheet metal of such arch-shaped protrusion into a unitary rivet button having a compound-curvature closed end and a substantially cylindrical sidewall portion contiguous to its open end, with
(i) forming of such rivet button being carried out so as to establish an average sheet metal thickness which is substantially uniform in such compound-curvature portion at such closed end and in such substantially cylindrical portion contiguous to its open end, by
limiting decrease in sheet metal thickness of such centrally-located sheet metal, during such rivet button fabrication, to about 1.5% to about 17.5% of sheet metal thickness of such centrally-location portion, and
(ii) returning remaining sheet metal from such peripheral portion arch-shaped protrusion to such substantially-planar scored sheet metal which is to be severed.

2. The process of claim 1, including
selecting a rigid flat-rolled steel can stock from the group consisting of:
(A) a double-reduced flat-rolled steel, having
a starting thickness gauge in a range of about 50 #/bb to about 70 #/bb, with
a tensile strength in a range of about 75 ksi to about 80 ksi; and
(B) a single-reduced flat-rolled steel, having
a thickness gauge in a range of above about 70 #/bb to about 85 #/bb, with
a tensile strength in the range of about 50 ksi to about 60 ksi.

3. The process of claim 2, in which substrate surfaces of such substantially-planar flat-rolled steel, are prepared by
(i) electrolytically plating each such surface with a corrosion-protective metallic plating, selected from the group consisting of:
tin, chrome-chrome oxide and nickel-zinc, and
(ii) precoating such corrosion protected flat-rolled steel surface, prior to such rivet button fabricating, with polymeric material and draw-processing organic lubricant.

4. The process of claim 1, comprising
selecting a rigid flat-rolled aluminum alloy sheet metal of the Al alloy 5000 H-19 Series, for food and beverage container end closure structures, having
a tensile strength in the range of about 52 ksi to about 62 ksi, with
a starting thickness gauge in the range of about 0.008" to about 0.01".

5. The process of claim 2, including
selecting such cylindrical portion of substantially uniform radius for such rivet button, so as to form a unitary rivet stem having a radius selected in the range of about 0.05" to less than about 0.0937", wherein
such annular bead is formed so as to define:
(i) an inner ring having a radius, measured from such central axis, which is in the range of about 1.5 to about 1.9 times such substantially uniform radius selected for such rivet button portion, and
(ii) an outer periphery ring having a radius, measured from such central axis, which is in the range of about 2.2 to about 2.6 times such substantially uniform radius selected for such rivet button portion.

6. Apparatus for carrying out the process of claim 1, comprising
(A) tooling means for displacing sheet metal, from a plane defined by such substantially-planar sheet metal, so as to form
an annular bead protruding from a substantially-planar surface of such sheet metal, defined by:
an outer periphery ring, and
a concentric inner ring,
such inner ring circumscribing a center panel, of substantially-planar sheet metal, in which:
sheet metal thickness of such center panel is not significantly decreased, and
sheet metal of such annular bead is decreased to average thickness in the range of about fifteen to about twenty percent from a selected starting sheet metal thickness gauge;
(B) tooling means for establishing about seventy to about eighty percent of desired longitudinal height for sheet metal of such rivet button, by
forming a large-diameter arch-shaped protrusion comprising sheet metal of such center panel and sheet metal of such annular bead, with
such arch-shaped protrusion presenting:
(i) a centrally-located compound-curvature portion, which
is substantially formed from sheet metal of such center panel, having
an average thickness which is about five percent less than the thickness of sheet metal of such center panel, and
(ii) a peripheral portion formed from sheet metal of such annular bead having an average thickness which is substantially the same as the average thickness of sheet metal of such annular bead, and
(C) tooling means:
(i) for draw-forming sheet metal of such centrally-located portion of such protrusion into:
a unitary rivet button having
a compound-curvature sheet metal portion at its closed end, which is at such desired longitudinal height for such rivet button, and
a substantially cylindrical configuration, in axial cross section, contiguous to its open end, with
average rivet button sheet metal thickness decreased from such selected starting thickness gauge in a range from less than about five percent to about twenty percent, and also (ii) for returning remaining peripheral sheet metal of such arch-shaped protrusion to such plane of such substantially-planar sheet metal.

7. Tooling for forming a unitary rivet button for securing a convenience-feature opener to a substantially-planar scored portion of rigid flat-rolled sheet metal of a container end closure structure, comprising (A) bead-forming die and punch tooling which coact to displace sheet metal from a substantially-planar surface of such sheet metal, so as to:

form an annular bead, between an outer ring and a concentric inner ring, in which sheet metal protrudes from a substantially-planar surface of such scored portion, and is decreased in thickness an average of about 20% from a selected sheet metal starting thickness gauge, and in which a center panel, radially inward of such inner ring, has an average sheet metal thickness which is not significantly decreased, with such center panel being disposed in substantially the same plane as such substantially-planar sheet metal scored portion;

(B) die and punch tooling which coact to displace sheet metal of such center panel and sheet metal of such annular bead, in relation to such substantially-planar sheet metal, so as to form a large-diameter protrusion from such sheet metal plane, having an arch-shaped configuration in axial cross section, in which average decrease in sheet metal thickness of such centrally-located sheet metal is about five percent, and average thickness of sheet metal annular bead, disposed peripherally of such arch-shaped protrusion, remains substantially unchanged from average thickness of sheet metal of such annular bead formed by such bead-forming tooling; and (C) coacting rivet button-forming punch and die tooling, for:

(i) forming such centrally-located sheet metal of such arch-shaped protrusion into a unitary rivet button by decreasing average thickness of such centrally-located sheet metal in the range of about one point five percent to about seventeen and a half percent, and (ii) returning such peripherally-disposed sheet metal of such protrusion to the plane of such substantially planar sheet metal scored portion.

8. A unitary rivet button for forming a unitary rivet for securing a convenience-feature opener to a scored portion substantially-planar flat-rolled sheet metal container-closure stock, such rivet button being formed by the process of claim 1, with such rivet button open end having a diameter in the range of about 0.09" to less than about 0.1875" and a height, above such planar sheet metal, of about 0.085" to about 0.1".

9. In combination with the rivet button of claim 8, a rigid flat-rolled sheet metal convenience-feature opener presenting a circular configuration aperture, having a radius which is correlated with such rivet button diameter, for receiving closed end sheet metal of such rivet button, for securing such opener to such sheet metal portion, by forming a rivet head from such closed-end portion of such rivet button, as protruding through such aperture presented by such sheet metal opener.

10. The rivet button of claim 9, wherein such unitary rivet button sheet metal is selected from the group consisting of:

(A) double-reduced flat-rolled steel, having a thickness selected within the range of 50 #/bb to 70 #/bb, with a tensile strength selected in the range of about 75 ksi to about 80 ksi, (B) single-reduced flat-rolled steel having a thickness in the range of above about 70 #/bb to about 85 #/bb, with a tensile-strength in the range of about 50 ksi to about 60 ksi; and (C) an aluminum alloy of the 5000 H-19 Series, having a starting thickness gauge in the range of about 0.008" to about 0.01", with a tensile strength in the range of about 52 ksi to about 62 ksi.

11. A unitary rivet button of preselected longitudinal height for securing a convenience-feature opener to a substantially-planar wall portion of a flat-rolled aluminum alloy can end, such rivet button being formed by the process of claim 4, with such rivet button having a diameter at its open end in the range of about 0.011" to less than about 0.1875", for use with a convenience-feature aluminum alloy opener, presenting a circular configuration aperture formed with a diameter which is correlated with such rivet button diameter, for receiving a closed-end portion of such rivet button, and for securing such an opener to such substantially-planar wall portion, with a rivet head formed from such closed-end portion of such rivet button to have a diameter of above about 0.11" to about 0.2".

12. As a new product of manufacture, a rigid sheet metal convenience-feature end closure structure for a rigid sheet metal can body, including a substantially-planar endwall panel and circumscribing chime seam metal for hermetically sealing such end closure structure to such can body, with a convenience-feature opener made integral with a scored portion of such endwall panel by a unitary rivet established from a rivet button formed in accordance with the process of claim 1, and in which such endwall closure structure is prepared from surface-prepared rigid flat-rolled sheet metal end closure stock, selected from the group consisting of:

(A) double-reduced flat-rolled steel having a thickness gauge in the range of about 50 #/bb to about 70 #/bb, with a tensile-strength in the range of about 75 ksi to about 80 ksi;

(B) single-reduced flat-rolled steel having a thickness gauge in the range of above about 70 #/bb to about 85 #/bb; and (C) an aluminum alloy of the 5000 H-19 Series, having a thickness gauge in the range of about 0.008" to about 0.01", and a tensile-strength in the range of about 52 ksi to about 62 ksi.

* * * * *